US006120423A

United States Patent [19]

Mackey et al.

[11] Patent Number: 6,120,423

[45] **Date of Patent: *Sep. 19, 2000**

[54] VARIABLE RESISTANCE EXERCISE APPARATUS

[76] Inventors: Teri R. Mackey, 266 Las Lomas Dr., Novato, Calif. 94949; Kenneth Tarlow, 21 Golden Hind Pass., Corte Madera, Calif. 94925

[ * ] Notice: This patent issued on a continued prosecution application filed under 37 CFR 1.53(d), and is subject to the twenty year patent term provisions of 35 U.S.C. 154(a)(2).

[21] Appl. No.: 09/025,501

[22] Filed: Feb. 18, 1998

[51] Int. Cl.[7] ..... A63B 21/02

[52] U.S. Cl. ..... 482/121; 482/127; 482/142

[58] Field of Search ..... 482/127, 142, 482/116, 117, 123, 129, 130

[56] References Cited

U.S. PATENT DOCUMENTS 3,596,907 8/1971 Brighton ..... 482/127

4,170,351 10/1979 Ozbey et al. ..... 482/142

5,540,642 7/1996 Sprague ..... 482/123

5,685,811 11/1997 McShane et al. ..... 482/114

*Primary Examiner*—Jerome Donnelly

[57] ABSTRACT

An exercise apparatus with a plurality of infinitely adjustable resistance mechanisms, a flat horizontal platform having a plurality of sockets located about its perimeter capable of receiving the resistance mechanisms and a pair of smaller arm sized platforms, also containing sockets, rotatably pinned to the main platform. The resistance mechanism has a constant force spring that allows a nylon cable to retract quickly and has a belville spring washer that increases resistance on the retractable cable as a tension knob is turned clockwise. A ratchet plate allows resistance to be felt on the outward pull of the cable but no resistance to be felt on the inward retraction of the cable. A ring member attaches to the nylon cable is capable of acting as a hand grip or a foot retainer.

4 Claims, 4 Drawing Sheets

VARIABLE RESISTANCE EXERCISE APPARATUS

BACKGROUND OF THE INVENTION

This invention relates generally to the field of exercise equipment, and more particularly to a variable resistance exercise apparatus.

Exercise equipment of various types has been used for many years. In recent times, the increased sedentary lifestyle of today's work activity means that many people find in necessary and desirable to exercise all major muscle groups on a regular basis and preferably in the privacy of their own homes.

Existing exercise devices include weights mounted on pulleys, rubber band resistance cables having a gripping means at one end and attached to a stationary, immovable object at the opposite end, and isometric type exercises which use ones own body weight as a resistance element.

Deficiencies in the prior technology include the fact that weight related exercise apparatus tend to be heavy and hard to move and store easily. Additionally, they tend to exercise one muscle group at a time and require time consuming change of set up to exercise a different muscle group. Rubber band resistance type exercise devices do not have a constant force when resistance is applied and tend to have a less satisfactory feel than a constant type resistance force. Isometric type exercise uses only the resistance provided by ones own body weight that limits the range of resistance that one can apply to a particular muscle group.

SUMMARY OF THE INVENTION

The primary object of the invention is to provide an exercise device that uses a pair of infinitely adjustable resistance modules to provide exercise for all major muscle groups.

Another object of the invention is to provide an exercise device that allows the user to remove and replace the resistance modules in various locations for exercising muscles associated with those locations.

Another object of the invention is to provide an exercise device that is lightweight and easy to store.

A further object of the invention is to provide an exercise device that is easy and economical to manufacture.

In accordance with an embodiment of the invention, an exercise apparatus comprises a plurality of infinitely adjustable resistance mechanisms; a flat, horizontal platform having a plurality of sockets located about its perimeter capable of receiving the resistance mechanisms; and a pair of smaller, arm sized platforms, also containing sockets, rotatably pinned to said horizontal platform.

In accordance with another embodiment of the invention, an exercise apparatus comprises a generally flat platform having a plurality of peripherally located sockets; and one or more adjustable resistance mechanisms adaptable to fit in said sockets. The preferred embodiment further comprises a pair of arm sized platforms having one or more peripherally located sockets, rotatably pinned to said horizontal platform.

Other objects and advantages of the present invention will become apparent from the following descriptions, taken in connection with the accompanying drawings, wherein, by way of illustration and example, an embodiment of the present invention is disclosed.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
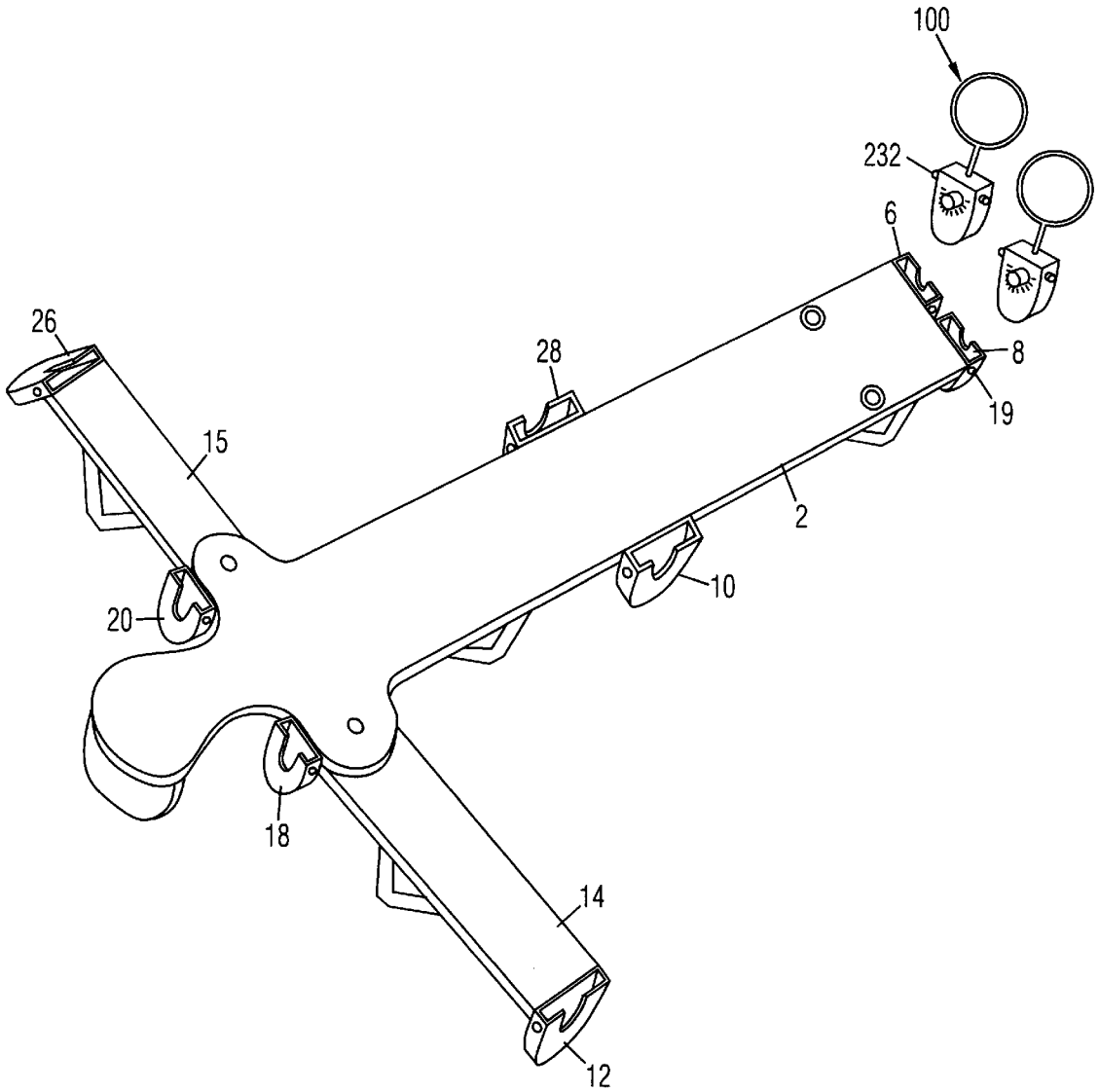
FIG. 1 is a perspective view of the exercise apparatus of the present invention.

Referring now to FIG. 1 we see the exercise apparatus of the present invention which includes a main horizontal platform 2 and rotatable attached arm platforms 14, 15. Main platform 2 and arm platforms 14, 15 have pockets or sockets 6, 8, 10, 12, 18, 20, 26, and 28 at various locations about their perimeters. These sockets hold variable resistance mechanisms 100. The device can be provided to users with one set of resistance mechanisms 100 or there can be provided a resistance mechanism 100 in each of the multiple sockets described above. The resistance mechanisms 100 are held into their respective sockets when spring pin 232 snaps into holes 19 located on either side of each socket. Other methods of securing the resistance mechanisms to the platform 2 include hooks and corresponding eyebolts or a pin and cleaves combination.

Figure 2:
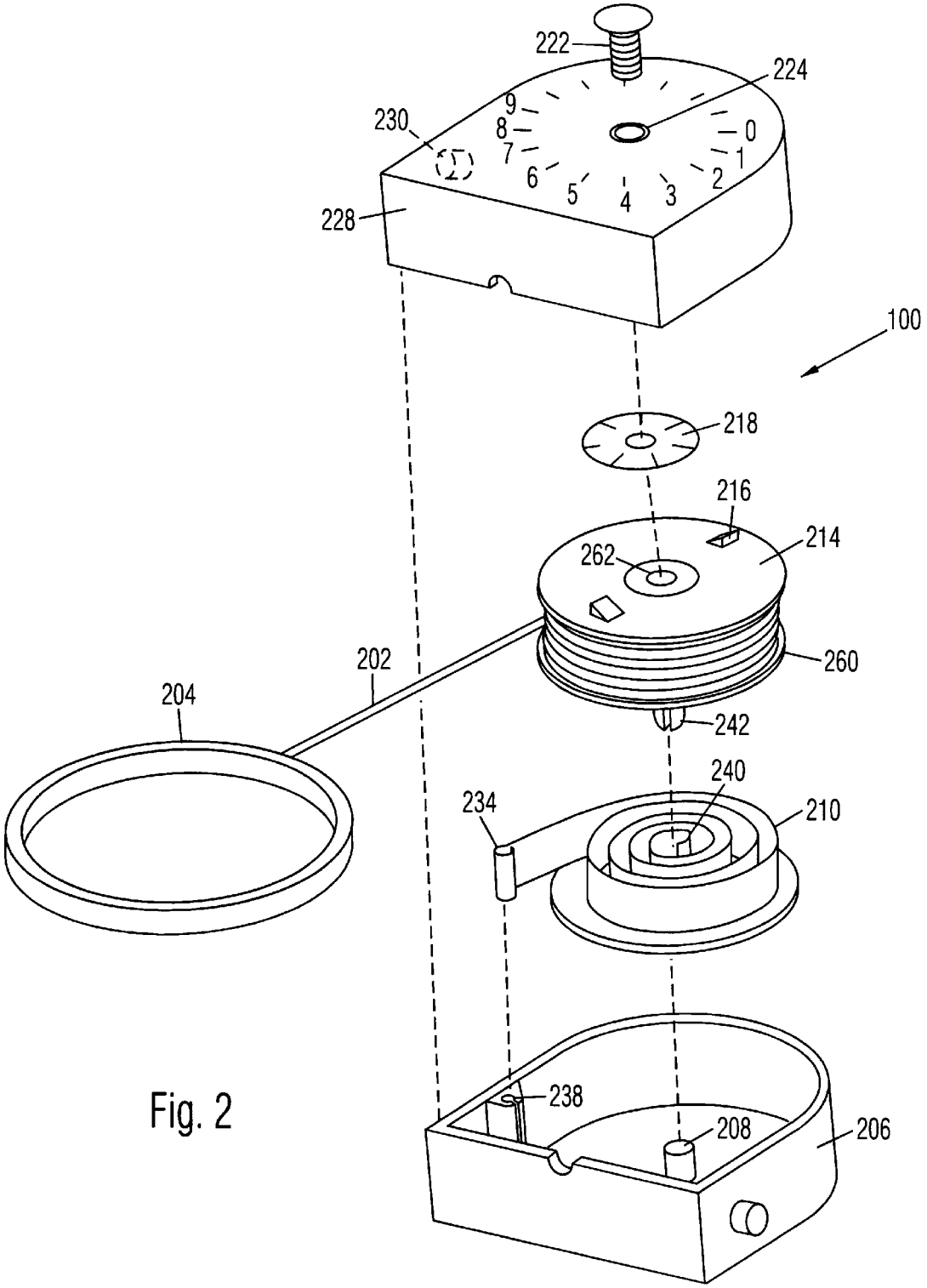
FIG. 2 is an exploded view of the variable resistance mechanism of the present invention.

FIG. 2 shows an exploded view of resistance mechanism 100. Rigid case halves 206, 228 enclose a constant force spring reel 210 which revolves about pin 208 in the lower housing 206. One end 234, of the spring reel 210 is anchored to the inside wall of lower housing 206 at point 238. The other end of the spring reel 240 is captured by split shaft 242. Attached circular reel plate 214 has raised elements 216 which interface with spring pin 230 in upper case 228 producing a ratchet action where nylon cable 202 can be pulled out with varying degrees of resistance based on how far knob 224 has been turned and threaded shaft 222 screwed into threaded hole stationary shaft 262 in a clockwise direction causing belville washer 218 to compress against plate 214 and thereby provide increased resistance, yet move with no resistance on the inward motion as nylon cable 202 as rewinds onto spool 260. In this way a person can pull on ring 204 in a resistive fashion and then effortlessly let the nylon cable 202 retract thereby getting ready for another repetition. Resistive belville washer 218 can be replaced by other resistive materials such as a compressible rubber washer or a compression spring.

Figure 3:
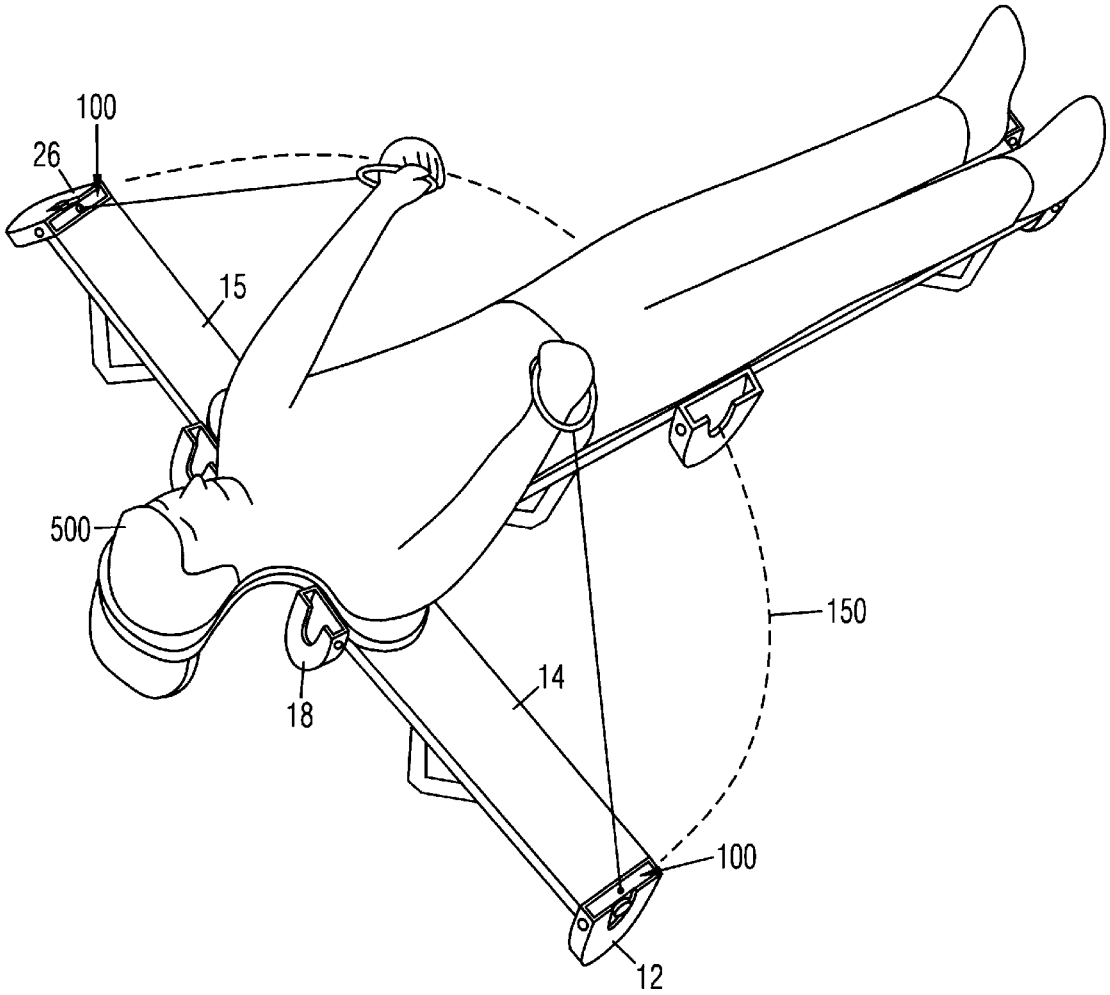
FIG. 3 is a perspective view of a person using the present invention for arm exercise.

FIG. 3 shows a person 500 using the exercise apparatus of the present invention. Resistive mechanisms 100 are snapped into sockets 26 and 12. Arm platforms 14 and 15 can be positioned anywhere along arc 150 for ease of operation. In this position a user can do an arm curl, keeping his or her elbow on the platform 14, 15 or a complete arm raise as shown. Obviously many other positions are obtainable with the present invention to work all bodily muscle groups.

Figure 4:
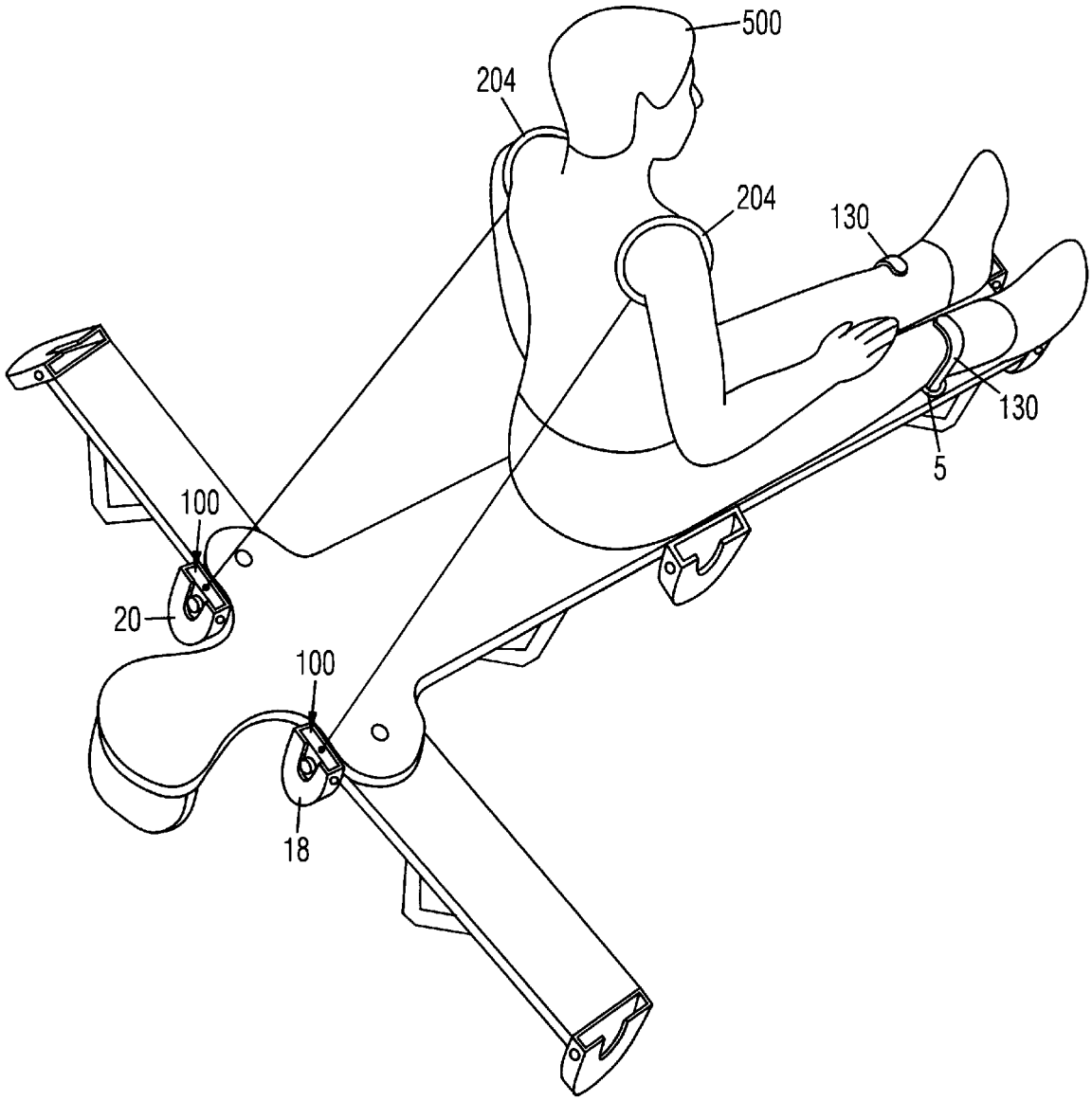
FIG. 4 is a perspective view of a person using the present invention to do sit-ups.

FIG. 4 shows a person 500 doing a standard sit up. In this case the person 500 has pulled the holding rings 204 up to his or her shoulders. Resistive elements 100 are in sockets 18 and 20. When the person sits up, he or she feels the added resistance of the resistance mechanisms 100 that add to the workout normally associated with sit-ups thereby increasing abdominal muscle tone. Leg restrains 130 plug into sockets 5 for additional leg support while doing sit-ups.

In the above described way a person can use one lightweight, compact, economical, full body exercise unit in which the user can easily and quickly move the resistance mechanisms to the desired location and set the degree of resistance to the desired amount. Once set, the resistance is of a constant nature which is preferable for repetitive muscle flexing.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. An exercise apparatus comprising:

a plurality of adjustable resistance mechanisms;

a flat, horizontal platform having a plurality of sockets located about its perimeter, said resistance mechanisms being received in said sockets; and a pair of smaller, arm sized platforms, also containing sockets, rotatably pinned to said horizontal platform.

2. The exercise apparatus as claimed in claim 1 wherein said resistance mechanism includes a constant force spring that retracts a cable; a belville spring washer that increases resistance on said cable as a tension knob is turned; and a ratchet plate that provides resistance on the outward pull of said cable but no resistance on the inward retracting of the said cable; and a ring member attached to said cable as a hand grip.

3. An exercise apparatus comprising:

a generally flat platform having a plurality of peripherally located sockets; and a plurality of adjustable resistance mechanisms removably secured in said sockets, wherein there is a greater number of said sockets than said resistance mechanisms, so that said resistance mechanisms are movable to different ones of said sockets for exercising different muscles.

4. An exercise apparatus comprising:

a generally flat platform having a plurality of peripherally located sockets;

a plurality of holes on opposite sides of each of said sockets;

a plurality of adjustable resistance mechanisms; and a plurality of spring pins extending from opposite sides of each of said resistance mechanisms, wherein said spring pins detachably engage respective holes in respective sockets to detachably secure said resistance mechanisms in said sockets;

wherein there is a greater number of said sockets than said resistance mechanisms, so that said resistance mechanisms are movable to different ones of said sockets for exercising different muscles.

* * * * *